US011185212B2

(12) United States Patent
Ford, Jr. et al.

(10) Patent No.: US 11,185,212 B2
(45) Date of Patent: Nov. 30, 2021

(54) STATUS INDICATOR AND LIGHTING ASSEMBLY FOR AN APPLIANCE DOOR

(71) Applicant: Haier US Appliance Solutions, Inc., Wilmington, DE (US)

(72) Inventors: Bradley Duane Ford, Jr., Vine Grove, KY (US); Justin Tyler Brown, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 651 days.

(21) Appl. No.: 16/104,974

(22) Filed: Aug. 20, 2018

(65) Prior Publication Data

US 2020/0054189 A1 Feb. 20, 2020

(51) Int. Cl.

| | |
|---|---|
| ***A47L 15/42*** | (2006.01) |
| ***F21V 33/00*** | (2006.01) |
| *F21Y 115/10* | (2016.01) |

(52) U.S. Cl.

CPC ..... *A47L 15/4293* (2013.01); *A47L 15/4257* (2013.01); *A47L 15/4274* (2013.01); *F21V 33/0044* (2013.01); *A47L 2501/26* (2013.01); *F21Y 2115/10* (2016.08)

(58) Field of Classification Search

None

See application file for complete search history.

(56) References Cited

U.S. PATENT DOCUMENTS

| | | | |
|---|---|---|---|
| 8,810,423 | B2 | 8/2014 | Kaczmarek et al. |
| 9,161,675 | B2 | 10/2015 | Eng et al. |
| 9,439,552 | B2 | 9/2016 | Fischer et al. |

FOREIGN PATENT DOCUMENTS

| | | | |
|---|---|---|---|
| WO | WO2014101930 | A1 | 7/2014 |

*Primary Examiner* — Rita P Adhlakha

(74) *Attorney, Agent, or Firm* — Dority & Manning, P.A.

(57) ABSTRACT

A door assembly for an appliance includes an inner door, an outer door, and a lighting assembly positioned therebetween for illuminating a status indicator mounted on the outer door. The lighting assembly may include a mounting flange and a spring-loaded lighting board that engages an alignment feature mounted on the outer door when the door assembly is assembled, thereby aligning the light sources on the lighting board with the status indicator.

20 Claims, 8 Drawing Sheets

STATUS INDICATOR AND LIGHTING ASSEMBLY FOR AN APPLIANCE DOOR

FIELD OF THE INVENTION

The present disclosure relates generally to door assemblies for appliances, and more particularly to lighting assemblies and status indicators mounted within doors of appliances.

BACKGROUND OF THE INVENTION

Appliances frequently include doors for closing, insulating, concealing, or otherwise providing selective access to cavities or chambers of the appliance. These doors typically include an inner door and an outer door that are separated by an air gap which may be filled with fiberglass or insulating foam, e.g., for thermal insulation, sound dampening, etc. In order to provide a user with information regarding the appliance operation, e.g., such as a status of an operating cycle or an indication that a cycle is complete, status indicators are often positioned on the outer door of the appliance such that they are visible to a user of the appliance.

The status indicators are often light diffusers or light pipes that simply diffuse or transmit light generated by a separate light source. Notably, it is often desirable to properly line up the light source with the light pipe to achieve consistent brightness, intensity, and uniformity. Typically, light sources are mounted to light boards that are directly coupled to the inner door to reduce wiring complexity of such light sources and to simplify the assembly of the door. However, such a construction may require the complete wiring of the light board prior to installation of the outer door, which may cause difficulties in properly aligning the light sources (which are fixed to the inner door) with the status indicators (which are fixed to the outer door).

Accordingly, an appliance having features for simplified assembly and improved illumination of status indicators would be useful. More specifically, a lighting assembly for an appliance that permits simple assembly of an inner door and an outer door with proper alignment of a light source and external status indicator would be particularly beneficial.

BRIEF DESCRIPTION OF THE INVENTION

Aspects and advantages of the invention will be set forth in part in the following description, may be apparent from the description, or may be learned through practice of the invention.

In accordance with one exemplary embodiment of the present disclosure, a door assembly for an appliance is provided. The door assembly includes an inner door, an outer door spaced apart from the inner door to define a door gap, and a status indicator mounted to the outer door. An alignment feature is mounted to the outer door and extends into the door gap and a lighting assembly is positioned within the door gap. The lighting assembly includes a mounting flange mounted to the inner door, a board assembly including at least one light source for illuminating the status indicator, and a biasing assembly operably coupling the board assembly to the mounting flange, the biasing assembly configured for urging the board assembly against the alignment feature to align the light source with the status indicator.

In accordance with another exemplary embodiment of the present disclosure, a dishwasher appliance defining a vertical direction, a lateral direction, and a transverse direction is provided. The dishwasher appliance includes a wash tub positioned within the cabinet and defining a wash chamber, a door assembly pivotally mounted to the cabinet to provide selective access to the wash chamber, the door assembly including an inner door and an outer door spaced apart from the inner door to define a door gap, and a status indicator mounted to the outer door and including an alignment feature. A lighting assembly is positioned within the door gap and includes a mounting flange mounted to the inner door, a board assembly including at least one light source for illuminating the status indicator, and a biasing assembly positioned between the mounting flange and the board assembly for urging the board assembly against the alignment feature to align the light source with the status indicator.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
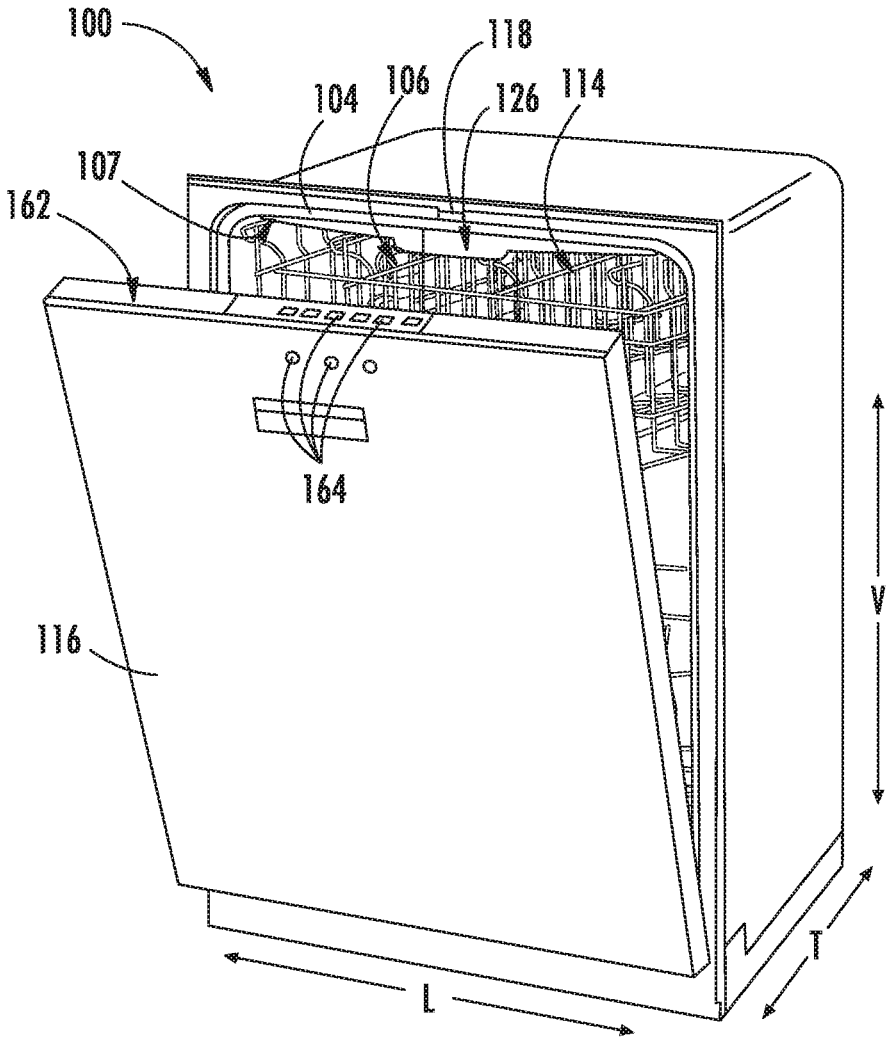
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
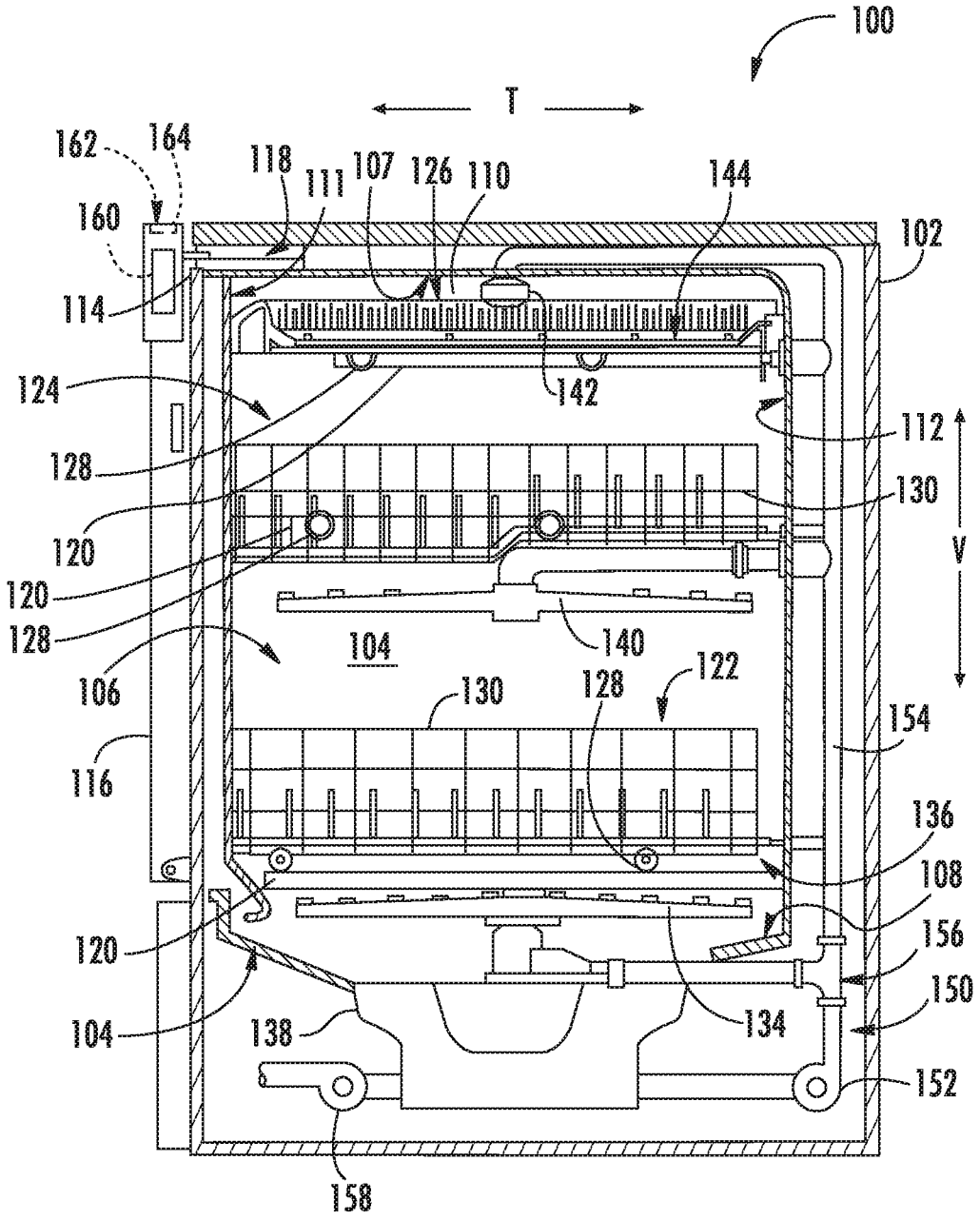
FIG. 2 provides a side, cross sectional view of the exemplary dishwashing appliance of FIG. 1.
Figure 3:
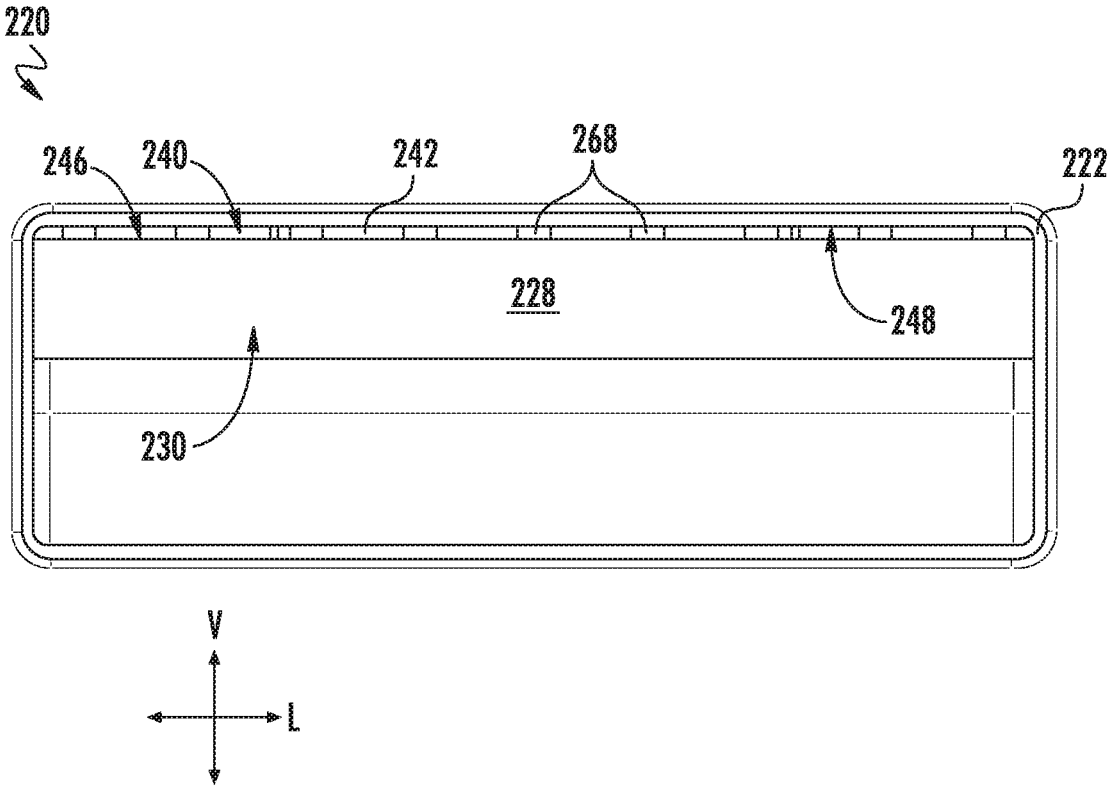
FIG. 3 provides a front view of a handle assembly of the exemplary dishwashing appliance of FIG. 1 according to an example embodiment of the present subject matter.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a circulation pump 152 for circulating water and wash fluid (e.g., detergent, water, and/or rinse aid) in the tub 104. Circulation pump 152 may be located within sump 138 or within a machinery compartment located below sump 138 of tub 104, as generally recognized in the art. Fluid circulation assembly 150 may include one or more fluid conduits or circulation piping for directing water and/or wash fluid from circulation pump 152 to the various spray assemblies and manifolds. For example, as illustrated in FIG. 2, a primary supply conduit 154 may extend from circulation pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from circulation pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, circulation pump 152 draws wash fluid in from sump 138 and pumps it to a diverter assembly 156, e.g., which may include a diverter disk disposed within a diverter chamber (not shown) for selectively distributing the wash fluid to the spray arm assemblies 134, 140, 142 and/or other spray manifolds or devices. For example, the diverter disk may have a plurality of apertures that are configured to align with one or more outlet ports (not shown) at the top of the diverter chamber. In this manner, the diverter disk may be selectively rotated to provide wash fluid to the desired spray device.

According to an exemplary embodiment, diverter assembly 156 is configured for selectively distributing the flow of wash fluid from circulation pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack. Fluid circulation assembly 150 may further include a drain pump 158 for selectively discharging wash fluid within sump 138, e.g., to an external drain.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter. Moreover, aspects of the present subject matter may be applied to other appliances as well, such as refrigerators, ovens, microwaves, etc.

Referring now generally to FIGS. 3 through 8, a door assembly 200 will be described according to exemplary embodiments of the present subject matter. For example, door assembly 200 may be used as door 116 of dishwashing appliance 100. Alternatively, door assembly 200 may be used on any appliance that includes status indicators or other information displays mounted on a door of the appliance. As described herein, door assembly 200 may share a coordinate system with dishwashing appliance 100, e.g., when door assembly 200 is in the closed position (e.g., as shown in FIG. 2). Specifically, door assembly 200 may define a vertical direction V, a lateral direction L, and a transverse direction T.

Figure 4:
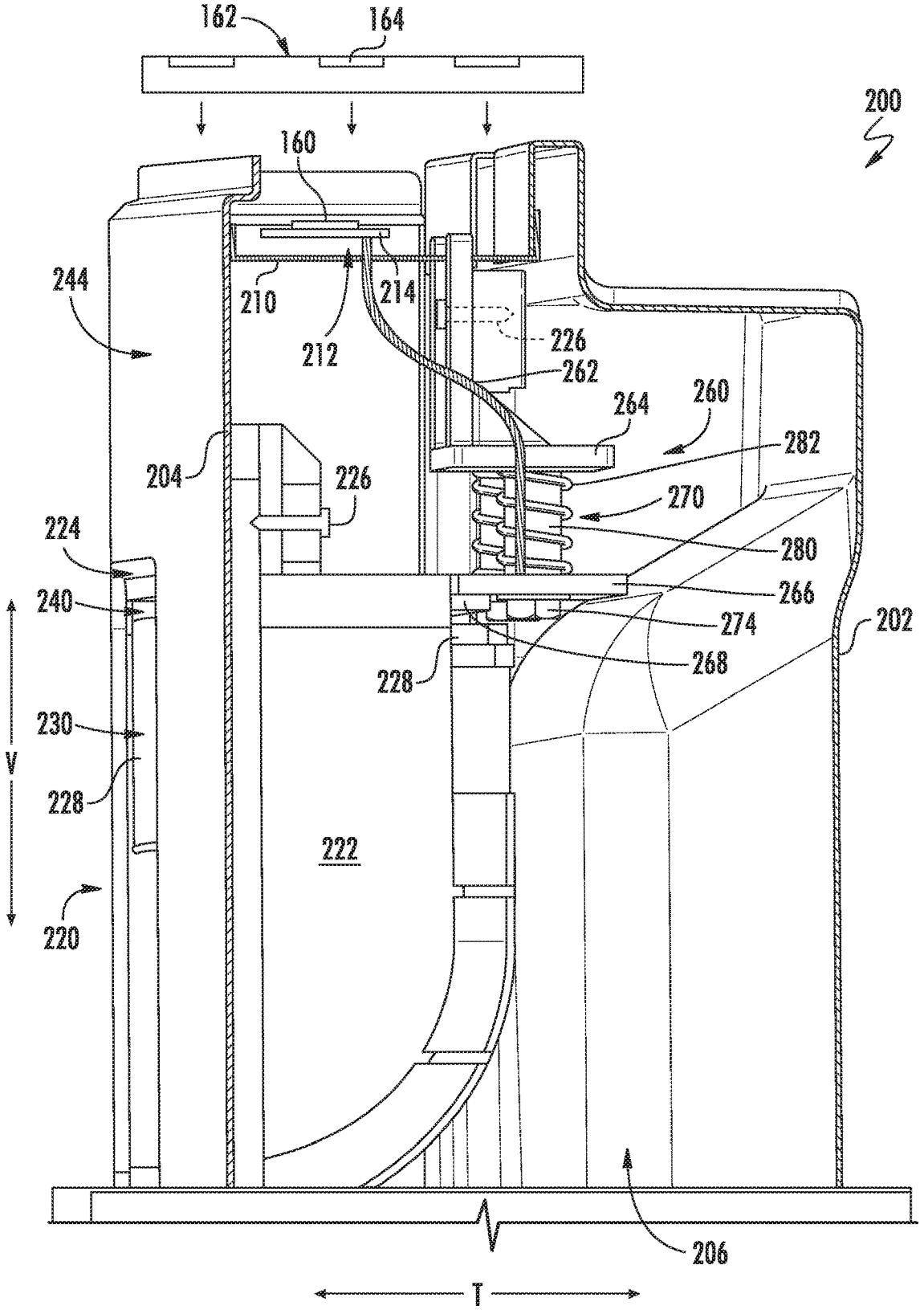
FIG. 4 provides a perspective, cross sectional view of a door assembly of the exemplary dishwashing appliance of FIG. 1 according to an example embodiment of the present subject matter.
Figure 5:
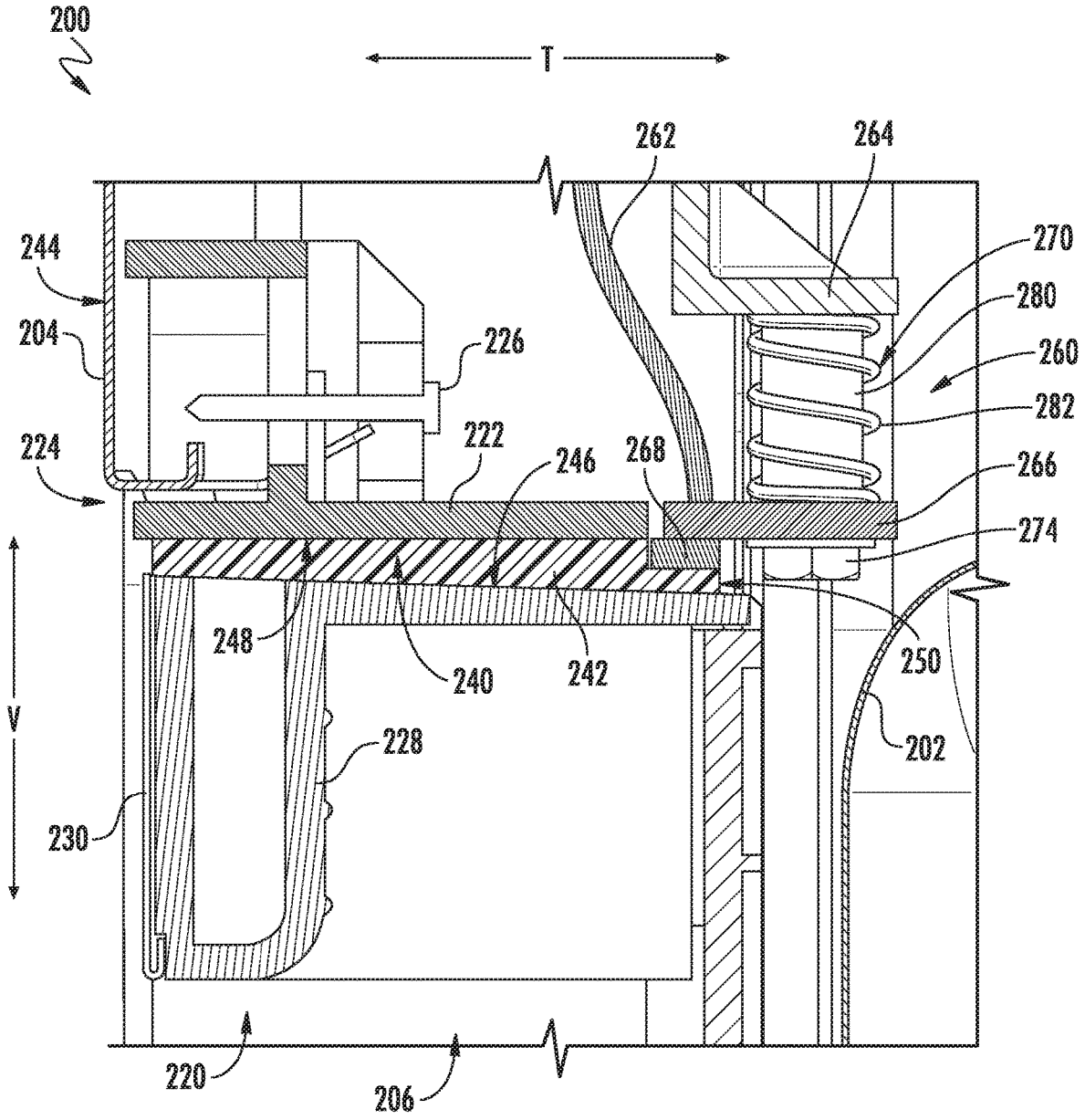
FIG. 5 provides a cross sectional view of a handle assembly of the exemplary door assembly of FIG. 4 according to an example embodiment of the present subject matter.

As best illustrated in FIGS. 4 and 5, door assembly 200 generally includes an inner door 202 and an outer door 204 which are spaced apart from each other along the transverse direction T to define a door gap 206 therebetween. According to exemplary embodiments, inner door 202 and outer door 204 may be panels that are stamped from stainless steel. Alternatively, inner door 202 and outer door 204 may be formed from any other suitably rigid material, such as thermoformed plastic, other metals, etc.

In general, inner door 202 and outer door 204 may be assembled in any suitable manner. For example, according to the illustrated embodiment inner door 202 and outer door 204 define complementary features that permit outer door 204 to slide onto inner door, e.g., upward along the vertical direction V. After outer door 204 slid into place, the two doors may be secured using any suitable mechanical fastener, welding, snap-fit mechanisms, etc. In addition, it should be appreciated that an insulating material (not shown), such as fiberglass or foam insulation, may be positioned within door gap 206 to provide thermal and or sound insulation to dishwashing appliance 100.

Referring now briefly to FIGS. 2 and 4, door assembly 200 may further include a console bracket 210 which is positioned at a top of door assembly 200 along the vertical direction V. Specifically, console bracket 210 is positioned between and may be used to join inner door 202 and outer door 204. In addition, console bracket 210 may define an electronics compartment 212 which is configured for housing a main control board 214 which is operably coupled to a user interface panel (e.g. such as interface panel 162 of a dishwashing appliance 100).

Figure 6:
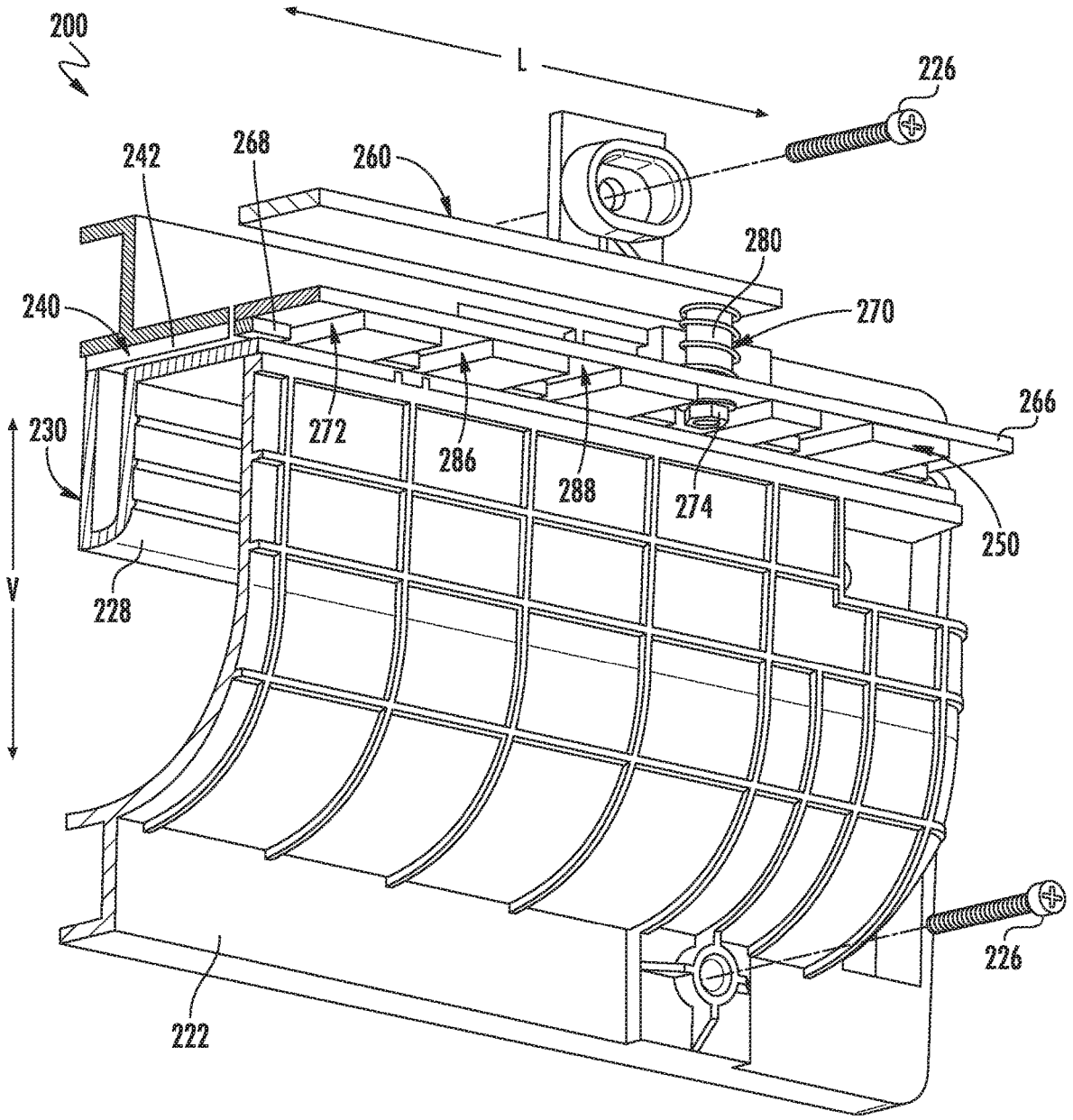
FIG. 6 provides a perspective, cross sectional view of the exemplary handle assembly of FIG. 5 according to an example embodiment of the present subject matter.

As best illustrated in FIGS. 3 through 6, door assembly 200 further includes a handle assembly 220 which is mounted to outer door 204. Specifically, according to the illustrated embodiment, handle assembly 220 includes a handle frame 222 that is fixed within an aperture 224 defined within outer door 204. In this regard, aperture 224 may be stamped within outer door 204 during fabrication and may be configured for securely receiving handle frame 222, e.g., via one or more mechanical fasteners 226 (FIG. 6). In addition, handle assembly 220 includes a pocket handle 228 which is fixedly mounted into handle frame 222. Pocket handle 228 may be further configured for receiving an appearance piece 230 which may, for example, be a similar material, color, and appearance as outer door 204.

In addition, door assembly 200 may further include one or more status indicators 240 which may be fixedly mounted to outer door 204. As used herein, "status indicator" may be used to refer to any component of door assembly 200 which is configured for being illuminated by a light source. For example, according to the illustrated embodiment, status indicator 240 is a light diffuser or a light pipe 242 that extends from within door gap 206 to a front surface 244 of door assembly 200. Alternatively, status indicator 240 may be any suitable transparent or semitransparent feature for diffusing, directing, or otherwise transmitting light from a light source, as described below according to exemplary embodiments.

Specifically, as best shown in FIG. 5, light pipe 242 is positioned between a top surface 246 of pocket handle 228 and a bottom surface 248 of handle frame 222. Moreover, light pipe 242 may be tapered toward front surface 244, such that its rear end 250 is thicker than its front end. In this regard, top surface 246 of pocket handle 228 may be angled relative to the transverse direction T for securely receiving tapered light pipe 242 while still fitting tightly against bottom surface 248. In this manner, a large light source may be positioned proximate rear end 250, and tapered light pipe 242 may direct, focus, and intensify the generated light through light pipe 242.

Referring again generally to FIGS. 3 through 8, door assembly 200 may further include a lighting assembly 260 that is positioned within door gap 206 and is generally configured for illuminating status indicators 240, such as light pipe 242. Notably, lighting assembly 260 is generally mounted on inner door 202 and is electrically coupled to main control board 214 by a wiring harness 262. In this manner, wiring harness 262 may be a short and relatively inexpensive harness that is connected to lighting assembly 260 prior to installing outer door 204 during the assembly of door assembly 200. By contrast, if lighting assembly 260 were mounted on outer door 204, a much longer and costly wiring harness would be needed, particularly when outer door 204 slides onto inner door 202 as described herein.

Specifically, lighting assembly 260 includes a mounting flange 264 which is mounted to inner door 202 using any suitable mechanical fasteners (such as fasteners 226 as shown in FIG. 4). Thus, mounting flange 264 has a fixed vertical position relative to inner door 202. Lighting assembly 260 further includes a board assembly 266 which includes at least one light source 268 for illuminating status indicator 240. For example, according to the illustrated embodiment, board assembly 266 includes a printed circuit board and a light source 268 includes a plurality of light emitting diodes (LEDs). However, it should be appreciated that according to alternative embodiments, any other suitable mounting board may be used for light source 268 which may include any other suitable traditional light bulbs or sources, such as halogen bulbs, incandescent bulbs, glow bars, a fiber light source, etc.

Notably, it is often desirable to properly line up light source 268 with light pipe 242 or status indicator 240 to achieve consistent brightness, intensity, and uniformity. However, because lighting assembly 260 is mounted on inner door 202 and status indicator 240 is mounted on outer door 204, features for ensuring proper alignment are desirable. In this regard, lighting assembly 260 may further include a biasing assembly 270 that operably couples board assembly 266 to mounting flange 264. More specifically, biasing assembly 270 is configured for urging board assembly 266 against a feature fixed to outer door 204 to align light source 268 with status indicator 240, as described below.

More specifically, according to the illustrated embodiment, door assembly 200 may include an alignment feature 272 which is fixedly mounted to outer door 204 and extends into door gap 206. In general, biasing assembly 270 urges board assembly 266 onto alignment feature 272 to properly align light source 268. According to the illustrated embodiment, alignment feature 272 is light pipe 242 itself. In this manner, board assembly 266 is urged into direct contact with alignment feature 272 (i.e., the top surface of light pipe 242) when inner door 202 and outer door 204 are assembled. However, it should be appreciated that according to alternative embodiments, alignment feature 272 may be any other suitable feature that has a fixed vertical position relative to outer door 204 and a known distance from light pipe 242. For example, board assembly 266 may include a standoff member, such as a retention fastener 274 (described below) which may extend off of board assembly 266 any suitable distance for engaging alignment feature 272 and properly positioning light source 268.

Referring again to FIGS. 4 through 8, biasing assembly 270 may be a spring assembly including one or more posts 280 that extend from mounting flange 264 toward board assembly 266. Board assembly 266 may define apertures (not shown) through which posts 280 may pass such that board assembly 266 is slidably mounted on posts 280. In addition, biasing assembly 270 may include one or more spring elements 282 that are positioned between mounting flange 264 and board assembly 266 to urge support assembly 266 away from mounting flange 264. Specifically, according to the illustrated embodiment, posts 280 and spring elements 282 extend substantially along the vertical direction V to urge board assembly 266 downward relative to inner door 202. It should be appreciated that as used herein, terms of approximation, such as "approximately," "substantially," or "about," refer to being within a ten percent margin of error.

In addition, biasing assembly 270 may include a retention fastener 274 that is attached to a distal end of the each post 280. Retention fastener 274 may include a larger head than the apertures defined in board assembly 266, thereby preventing board assembly 266 from sliding off posts 280. In addition according to the illustrated embodiment, spring elements 282 are wrapped around posts 280 to ensure proper alignment and movement of board assembly 266. In addition, as mentioned briefly above, retention fastener 274 may act as a standoff member which may contact alignment feature 272 to properly position light source 268 according to alternative embodiments.

Although biasing assembly 270 is described above as being a spring assembly using mechanical springs 282 mounted on alignment posts 280, it should be appreciated that any suitable device or mechanism for urging board assembly 266 or light source 268 into alignment with light pipe 242 may be used according to alternative embodiments. For example, biasing assembly 270 may be a collapsible or resilient foam, a mechanical actuator, a hydraulic system, or any other assembly that is configured for aligning light source 268 and light pipe 242 for proper illumination.

Figure 7:
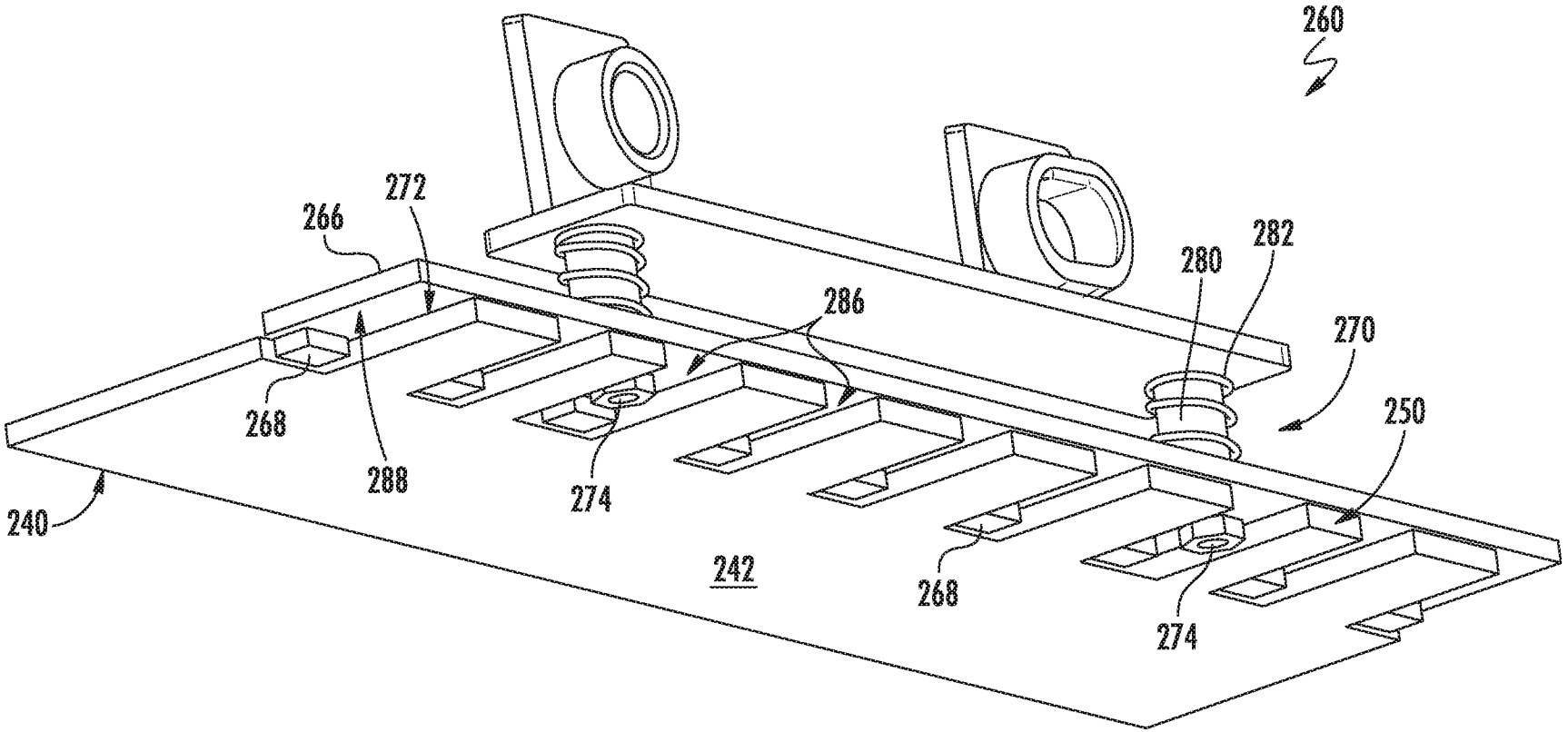
FIG. 7 provides a perspective view of a lighting assembly of the exemplary door assembly of FIG. 4 according to an example embodiment of the present subject matter.
Figure 8:
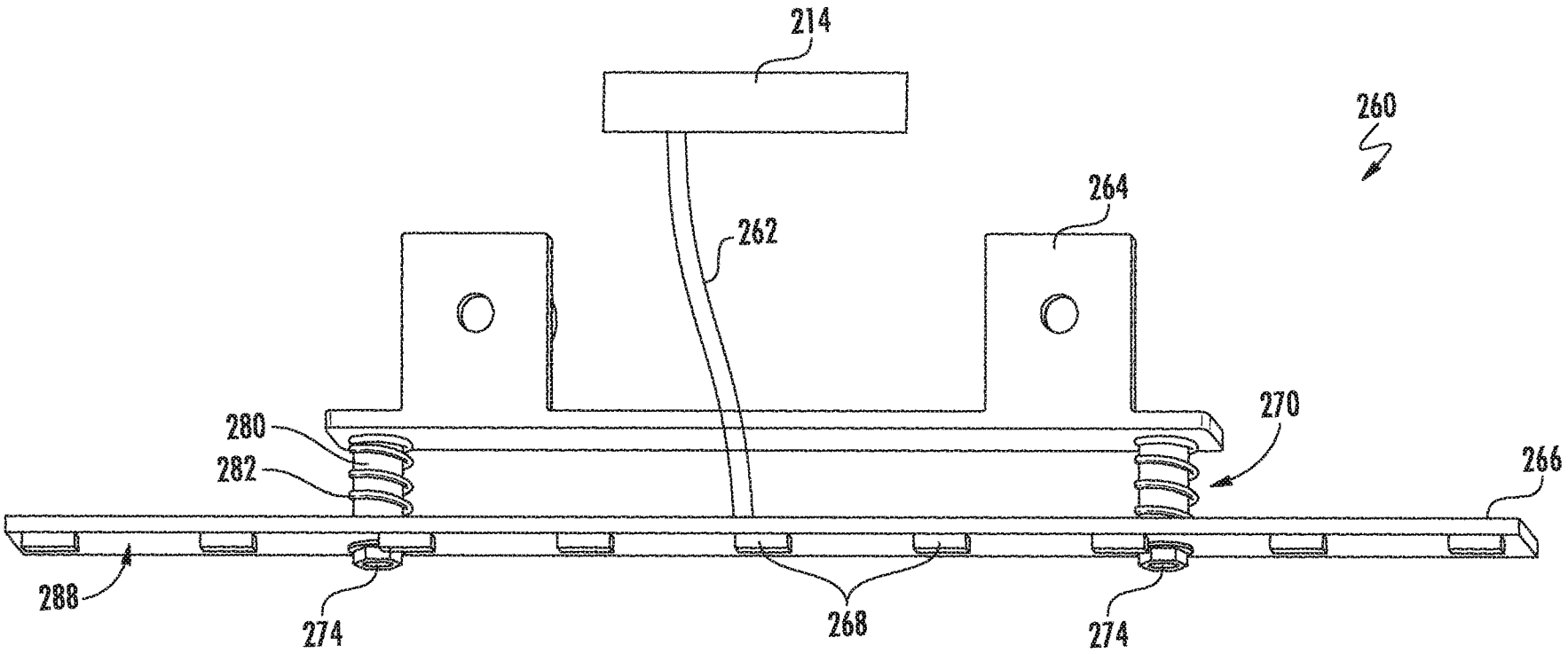
FIG. 8 provides another perspective view of the lighting assembly of FIG. 7 the exemplary door assembly of FIG. 4 according to an example embodiment of the present subject matter.

As best shown in FIGS. 6 through 8, to further facilitate improved alignment between light source 268 and light pipe 242, rear end 250 of light pipe 242 may define a plurality of slots 286. Specifically, light pipe 242 may define the same number of slots 286 as there are light sources 268. Specifically, according to the illustrated embodiment, lighting assembly 260 includes nine LED light sources 268 positioned on a bottom 288 of board assembly 266. In addition, light pipe 242 defines nine slots 286 for receiving each of the nine light sources 268. Thus, board assembly 266 is configured for sitting on top of light pipe 242 while light sources 268 are properly aligned within slot 286 of light pipe 242. In this regard, the top surface of light pipe 242 serves as alignment feature 272 for board assembly 266. Although slots 286 are illustrated as extending through the entire depth of light pipe 242, slots 286 might extend only through a portion of light pipe 242.

It should be appreciated that although dishwashing appliance 100 is used to describe door assembly 200, handle assembly 220, and lighting assembly 260 above, aspects of the present subject matter may be used for any other suitable appliance. For example, the present subject matter may be used in other dishwasher appliances, refrigerators, microwaves, ovens, and any other door assembly which includes status indicators that are illuminated by one or more light sources. In addition, modifications and variations may be made to the exemplary embodiments described herein while remaining within the scope of the present subject matter. This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A door assembly for an appliance, the door assembly comprising:
- an inner door;
- an outer door spaced apart from the inner door to define a door gap;
- a status indicator mounted to the outer door;
- an alignment feature mounted to the outer door and extending into the door gap; and
- a lighting assembly positioned within the door gap, the lighting assembly comprising:
  - a mounting flange mounted to the inner door;
  - a board assembly comprising at least one light source for illuminating the status indicator; and
  - a biasing assembly operably coupling the board assembly to the mounting flange, the biasing assembly configured for urging the board assembly against the alignment feature to align the light source with the status indicator.

2. The door assembly of claim 1, wherein the biasing assembly comprises:
- one or more posts, the board assembly being slidably mounted on the posts; and
- one or more spring elements positioned between the mounting flange and the board assembly to urge the board assembly away from the mounting flange.

3. The door assembly of claim 2, wherein the one or more spring elements and the one or more posts extend along the vertical direction to urge the board assembly downward relative to the inner door.

4. The door assembly of claim 2, wherein the biasing assembly comprises:
- a mechanical fastener that is attached to a distal end of each of the one or more posts, the mechanical fastener being configured for preventing the board assembly from sliding off of the one or more posts.

5. The door assembly of claim 1, wherein the status indicator is a light pipe.

6. The door assembly of claim 5, wherein the light pipe is the alignment feature.

7. The door assembly of claim 1, wherein the status indicator is part of a handle assembly mounted to the outer door and is positioned at least partially within the door gap, the handle assembly comprising:
- a pocket handle mounted within the outer door, wherein the status indicator is mounted directly to the pocket handle.

8. The door assembly of claim 1, wherein a rear end of the status indicator defines at least one slot, and wherein the board assembly sits on top of the status indicator and the at least one light source is mounted on a bottom of the board assembly such that the light source is positioned within the slot.

9. The door assembly of claim 1, wherein the lighting assembly further comprises:
- a wiring harness that extends between the board assembly and a main control board of the appliance.

10. The door assembly of claim 1, wherein the board assembly is urged into direct contact with the alignment feature when the inner door and the outer door are assembled.

11. The door assembly of claim 1, wherein the board assembly comprises a standoff member that is urged into direct contact with the alignment feature.

12. The door assembly of claim 1, wherein the at least one light source is a light emitting diode (LED).

13. The door assembly of claim 1, wherein a console bracket is positioned at a top of the door between the inner door and the outer door, the console bracket defining an electronics compartment for receiving a main control board and a user interface panel.

14. The door assembly of claim 1, wherein the appliance is a dishwasher appliance.

15. A dishwasher appliance defining a vertical direction, a lateral direction, and a transverse direction, the dishwasher appliance comprising:
- a wash tub positioned within the cabinet and defining a wash chamber;
- a door assembly pivotally mounted to the cabinet to provide selective access to the wash chamber, the door assembly comprising an inner door and an outer door spaced apart from the inner door to define a door gap;
- a status indicator mounted to the outer door and comprising an alignment feature; and
- a lighting assembly positioned within the door gap, the lighting assembly comprising:
  - a mounting flange mounted to the inner door;
  - a board assembly comprising at least one light source for illuminating the status indicator; and
  - a biasing assembly positioned between the mounting flange and the board assembly for urging the board assembly against the alignment feature to align the light source with the status indicator.

16. The dishwasher appliance of claim 15, wherein the biasing assembly comprises:

one or more posts, the board assembly being slidably mounted on the posts; and one or more spring elements positioned around the posts between the mounting flange and the board assembly to urge the board assembly away from the mounting flange.

17. The dishwasher appliance of claim 15, wherein the status indicator is part of a handle assembly mounted to the outer door, the handle assembly comprising:

a pocket handle mounted within outer door, wherein the status indicator is mounted directly to the pocket handle.

18. The dishwasher appliance of claim 15, wherein a rear end of the status indicator defines at least one slot, and wherein the board assembly sits on top of the status indicator and the at least one light source is mounted on a bottom of the board assembly such that the light source is positioned within the slot.

19. The dishwasher appliance of claim 15, wherein the board assembly is urged into direct contact with the alignment feature when the inner door and the outer door are assembled.

20. The dishwasher appliance of claim 15, wherein a console bracket is positioned at a top of the door assembly between the inner door and the outer door, the console bracket defining an electronics compartment for receiving a main control board and a user interface panel.

* * * * *